US005619921A

United States Patent [19]

Iijima et al.

[11] Patent Number: 5,619,921

[45] Date of Patent: Apr. 15, 1997

[54] WIDTH ADJUSTING DEVICE AND METHOD FOR A PAPER WEB

[75] Inventors: Takashi Iijima, Yokosuka; Hideo Ohta, Tokyo, both of Japan

[73] Assignee: Kabushikigaisha Tokyo Kikai Seisakusho, Tokyo, Japan

[21] Appl. No.: 380,155

[22] Filed: Jan. 30, 1995

Related U.S. Application Data

[63] Continuation of Ser. No. 41,195, Apr. 1, 1993, abandoned.

[30] Foreign Application Priority Data

Jul. 28, 1992 [JP] Japan ..... 4-220867

[51] Int. Cl.[6] ..... B41F 5/06

[52] U.S. Cl. ..... 101/181; 101/485

[58] Field of Search ..... 101/219, DIG. 42, 101/220–225, 485, 181, 486; 226/95, 97, 3, 15, 17, 45, 34, 185, 186, 190; 34/156, 160, 444, 446, 448, 459, 464, 576, 611, 618, 619, 620; 242/419.5, 419.3, 419.7, 419.8

[56] References Cited

U.S. PATENT DOCUMENTS

| | | | |
|---|---|---|---|
| 3,147,898 | 9/1964 | Huck | 226/17 |
| 3,711,960 | 1/1973 | Overly et al. | 226/97 |
| 3,964,656 | 6/1976 | Hella | 226/97 |
| 3,982,327 | 9/1976 | Kurie et al. | 226/97 |
| 4,696,230 | 9/1987 | Barkley | 101/181 |
| 4,831,926 | 5/1989 | Bowman et al. | 101/181 |

FOREIGN PATENT DOCUMENTS

| | | | |
|---|---|---|---|
| 3513319 | 10/1986 | Germany | 101/181 |

OTHER PUBLICATIONS

Laubscher, "Stacked Modular Press Configurations or Satellites—a Systematic Comparison," *Newspaper Techniques*, Apr. 1988, pp. 64–73.

*Primary Examiner*—J. Reed Fisher
*Attorney, Agent, or Firm*—Foley & Lardner

[57] ABSTRACT

A web width adjusting device can adequately adjust the width of paper web which travels through at least two printing sections. The travelling web is sandwiched by a pair of wave forming devices including a plurality of fluid ejectors which are aligned in the width direction of the paper web. The fluid ejectors of one alignment face alternately the other alignment to alternately eject fluid to both sides of the web.

22 Claims, 5 Drawing Sheets

WIDTH ADJUSTING DEVICE AND METHOD FOR A PAPER WEB

This application is a continuation of application, Ser. No. 08/041,195, is filed Apr. 1,1993 now abandoned.

BACKGROUND OF THE INVENTION

1. Field of the Invention

The present invention generally relates to a width adjusting device for a paper web, which adjusts the width of the paper web for a printing system prior to a printing section. More particularly, the present invention relates to a lithographic rotary press which is equipped with at least one of the width adjusting device and a plurality of printing sections through which the paper web is successively travelled to be printed.

2. Description of the Prior Art

A typical conventional lithographic rotary press adapted for a color printing system is, for example shown in FIG. 4 which is a schematically elevational view. This conventional lithographic printing system comprises a plurality of printing sections P each of which includes two pairs of a combination of a plate cylinder PC and a blanket cylinder BC. The blanket cylinders BC of each the printing section P are vertically arranged to be in contact with each other. In this conventional printing system, four sets of the printing sections P are horizontally arranged in parallel as shown in FIG. 4. A paper web W is also horizontally travelled through the printing sections in which the paper web W is successively passed between the pairs of the blanket cylinders BC, BC to print both sides of the paper web W.

Another conventional lithographic rotary press for a color printing system is shown in FIG. 5. In this drawing, four printing sets each of which is composed of a plate cylinder PC and a blanket cylinder BC are radially arranged about an impression cylinder IC as a common center cylinder. The blanket cylinders BC are respectively in contact with the impression cylinder IC to form printing sections P. A paper web W is roundly travelled along the circumference of the impression cylinder IC so that the paper web W is successively passed through the four printing sections P defined between the blanket cylinders BC and the impression cylinder IC to print one side of the paper web W.

In recent years, many newspaper publishers have progressed to print newspaper in color inks and thus demanded to perform such color printing on many pages at a high speed in a limited printing space.

In order to satisfy such demands, another conventional lithographic rotary press for a color printing system has been proposed as shown in FIG. 6. In this printing system, each printing section P includes two sets of a blanket cylinder BC and a plate cylinder PC which are symmetrically arranged so as to bring the blanket cylinders BC into contact with each other. A paper web W is vertically travelled through the four printing sections P to print both sides of the paper web W in the same manner as the above described systems. This type of printing system is for example shown in "IFRA Newspaper Techniques English Edition", pp.64 to pp.73; April, 1988 published by INCA-FIEJ Research Association.

Paper webs used in various printing systems are generally produced in such manner that pulp fibers are mechanically cut and broken into fine particles; dispersed in water; dehydrated and dried; and finally adhered by hydrogen-bond to form paper in a web or sheet figure. Under moisture conditions, each of pulp fibers tends to extend a little less than 1 percent in its longitudinal direction and 20 to 30 percent in its radius direction. Thus, the paper web is extended in its longitudinal and width directions by dampening and/or watering operation. Most of the pulp fibers of general mechanically produced paper webs are orientated in the longitudinal direction of the paper web, so that paper webs are remarkably extended in their width direction.

In a specific lithographic printing system employing dampening or watering operation in printing a section, a paper web is swelled by the water supplied during the dampening operation. Therefore the image and lines printed on the paper web are also deformed in response to the swell of the paper web. In the printing systems including at least two lithographic printing sections each of which is associated with dampening means to successively print color images on the same paper web, the printed images or lines formed at the first printing section are not correctly coincided with the images or lines formed at the second and later printing sections. Accordingly, this will produce printed materials with poor quality.

BRIEF SUMMARY OF THE INVENTION

Therefore, it is a primary object of the invention to provide an improved width adjusting device for a paper web, which can be associated with a lithographic color-printing system including at least two printing sections using dampening means to successively print image and lines on the same paper web, and which can adjust the width of the paper web to correctly agree the former printed image with the succeeding printed image.

Another object of the present invention is to provide an improved width adjusting method for a paper web to successively print image and lines on the same paper web without any shears.

To accomplish the above described objects, a web width adjusting device according to the present invention comprises a pair of wave forming means between which a paper web is travelled. Each of the wave forming means includes a plurality of fluid ejectors which are aligned in the width direction of the paper web. The fluid ejectors of one alignment face alternately that of the other alignment.

Another aspect according to the present invention is characterized that a web width adjusting method comprises a wave forming step by alternately ejecting fluid to one side and the other side of the paper web so that a wave is formed in the longitudinal direction of the web.

In the width adjusting device according to the present invention, the paper web is subjected to fluid pressure alternately applied from the fluid ejectors aligned along the width of the paper web. Thus the fluid pressure causes the paper web to form a wave in the longitudinal direction of the web as the paper web is travelled toward a succeeding printing section. This wave-forming results in shortening the width of the paper web. The width shortened web reaches the to succeeding printing section and is subjected to a printing operation at the succeeding printing section. The paper web is kept in the width shortened state without any wrinkles and rucks during the succeeding printing operation.

Although the reason why the paper web can pass the printing section with keeping the width in shortened state and without any wrinkles and rucks is not clear, it may be considered that fibers of wave formed portions are gathered, not shown with the naked eye, and pressed by printing pressure. Thus the gatherd and pressed fibers may allow the width of the paper web to be stable.

In this width adjusting method according to the present invention, width of the paper web expanded owing to water supplied from the preceding printing section can be cancelled by wave-forming which permits the width to shorten. Therefore, the image and lines printed at the preceding printing section can coincide with that of the succeeding printing section.

Other objects and features of the invention will be apparent from a reading of the following description of the disclosure found in the accompanying drawings and the novelty thereof pointed out in the appended claims.

DETAILED DESCRIPTION OF THE PREFERRED EMBODIMENTS

One preferred embodiment, as the first embodiment, of the present invention will be described in detail with referring to the accompanying drawings FIG. 1 and FIG. 3.

Figure 3:
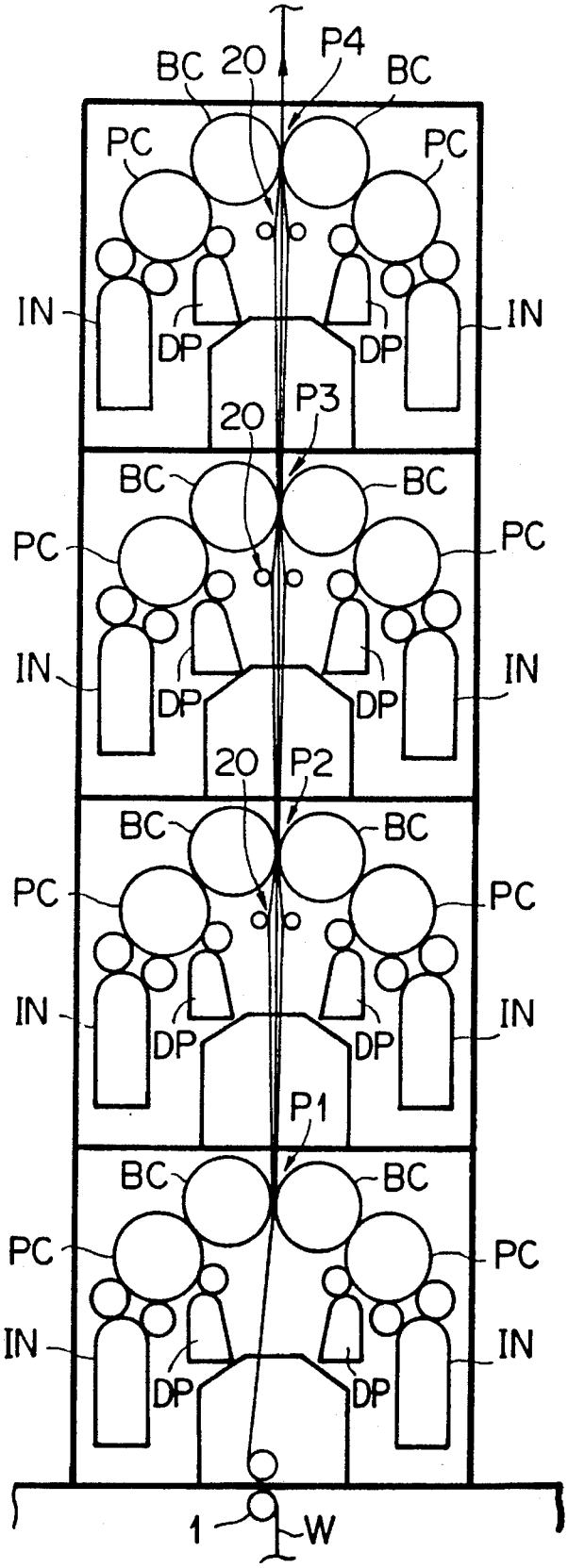
FIG. 3 is a schematic illustration showing an overall construction of a lithographic rotary press which is associated with a plurality of web width adjusting devices according to the present invention.
Figure 4:
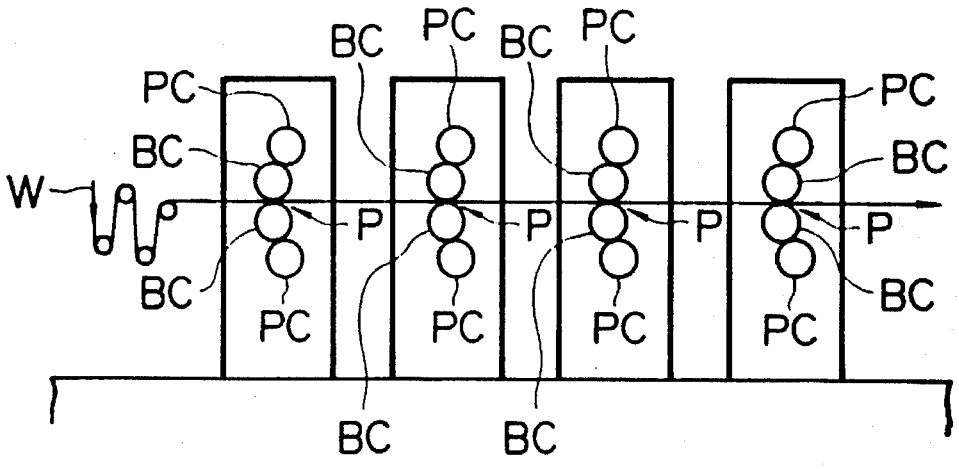
FIG. 4 is a schematic illustration showing one conventional configuration of a commonly used lithographic rotary press.
Figure 5:
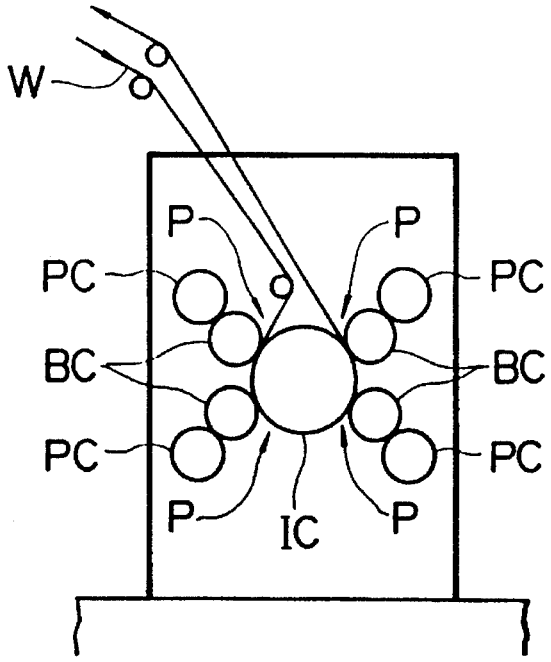
FIG. 5 is a schematic illustration showing another conventional configuration of a commonly used lithographic rotary press.
Figure 6:
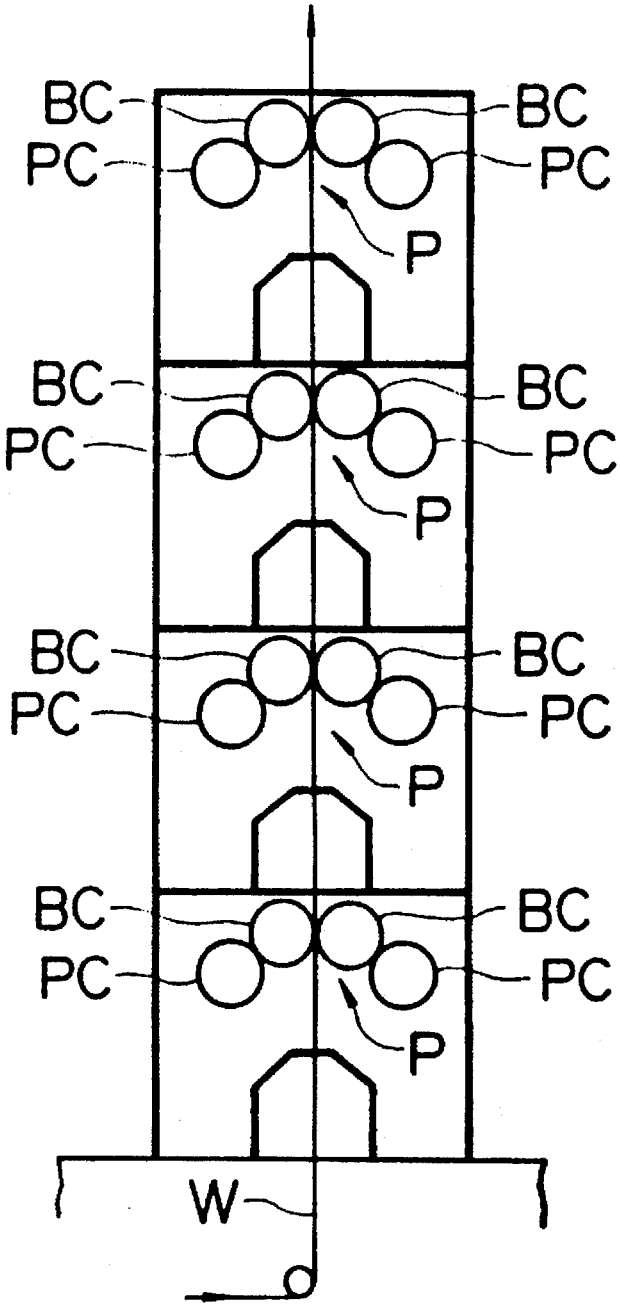
FIG. 6 is a schematic illustration showing another conventional configuration of a commonly used lithographic rotary press.

In FIG. 3, there is shown an overall constitution of a lithographic rotary press which comprises first to fourth printing sections P1, P2, P3 and P4 vertically arranged in the same manner as the above described conventional color-printing lithographic rotary press shown in FIG. 6. Each printing section includes two sets of a blanket cylinder BC and a plate cylinder PC which are symmetrically arranged so as to bring the blanket cylinders BC into contact with each other. A paper web W is vertically travelled from the first printing section P1 to the fourth printing section P4. Further, the rotary press shown in FIG. 3 comprises a plurality of web width adjusting devices 20, described later in detail.

In FIG. 3, IN and DP represent an inking unit and a dampening unit, respectively.

Figure 1:
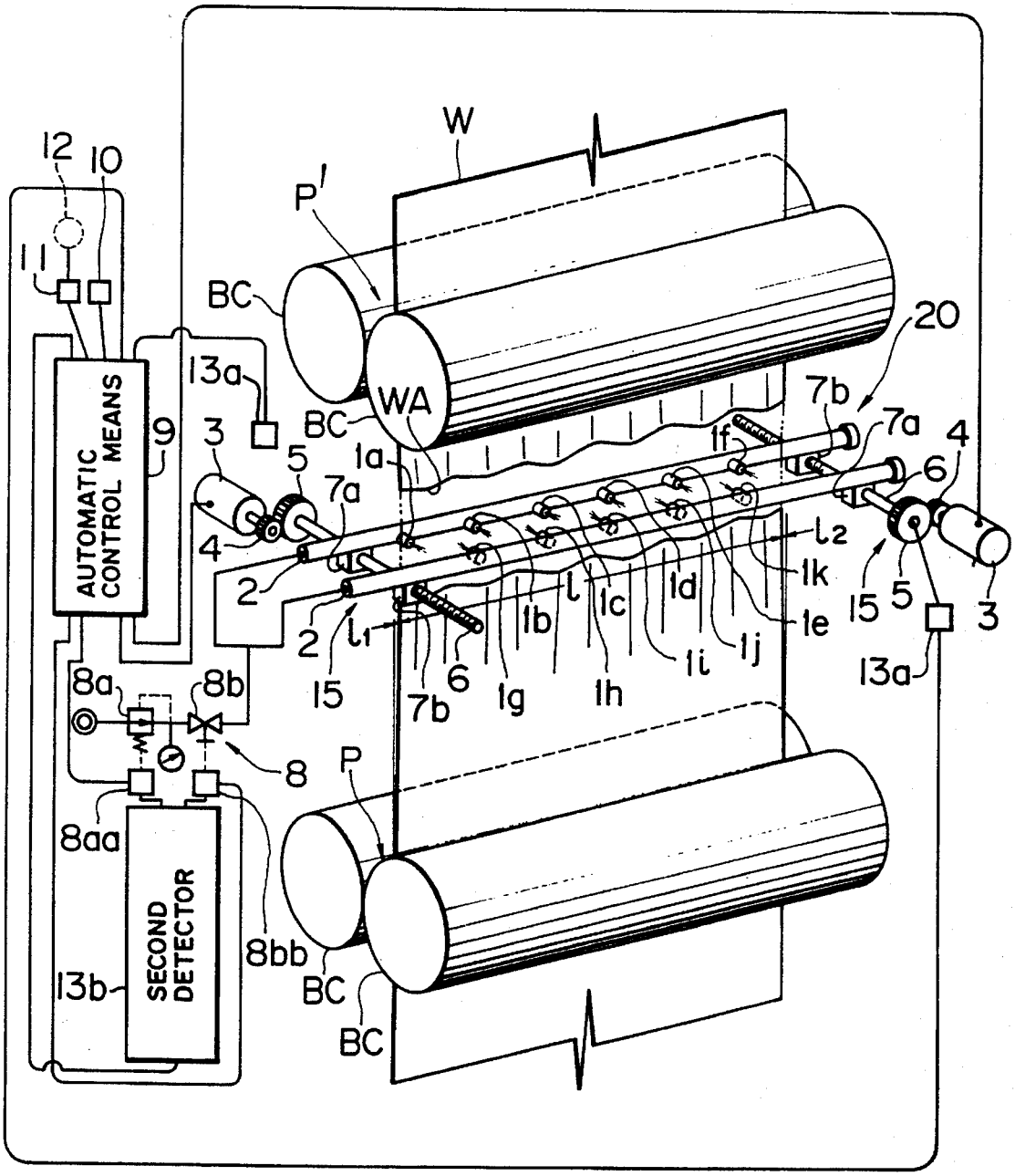
FIG. 1 is a schematically perspective view showing the first embodiment of a web width adjusting device according to the present invention.

The web width adjusting device 20 is typically shown in FIG. 1, wherein the device 20 comprises a pair of wave forming means between which the paper web W is travelled. Each of the wave forming means includes a first fluid feeding pipe 2 and a first series of fluid ejectors 1*a*, 1*b*, 1*c*, 1*d*, 1*e* and 1*f*; and a second fluid feeding pipe 2 and a second series of fluid ejectors 1*g*, 1*h*, 1*i*, 1*j*, and 1*k*. In the first series of the fluid ejectors 1*a* to 1*f*, they are isolated from each other at a regular interval. In the second series of the fluid ejectors 1*g* to 1*k*, they are also isolated from each other at a regular interval. The fluid ejectors 1*g* to 1*k* of the second series are respectively shifted half of the interval between the fluid ejectors of the first series, so that each fluid ejector of the second series is positioned at the center of two fluid ejectors of the first series as shown in FIG. 1.

The reference numeral 3 denotes a driving unit for a shifting means 15. In this embodiment, the driving unit is an electric motor whose drive shaft is secured with a driving gear 4. This driving gear 4 is meshingly engaged with a driven gear 5 which is secured to one end of a guide shaft 6 formed with a screw section. The guide shaft 6 penetrates through a base member 7*a* for supporting the fluid feeding pipe 2 near to the driven gear 5, and the screw section of the guide shaft 6 is meshingly engaged with a female screw, not shown, formed in another base member 7*b* for supporting the fluid feeding pipe 2 far from the driven gear 5. The reference numeral 8 shown in FIG. 1 denotes a regulator unit for regulating flow amount and rate of the fluid fed to the fluid ejectors 1*a* to 1*k*. In this embodiment, the regulator unit 8 includes a regulator 8*a* and a valve 8*b*.

The reference numeral 9 denotes an automatic control means which is electrically operated by an input means 10 such as a key board and a detecting means 11 which detects various operation information such as speed of a main motor 12 representing travelling speed of the paper web W. The control means 9 is electrically connected to a first detecting means 13*a* for detecting the distance between the fluid ejectors 1*a* to 1*k* and the paper web W. Since this distance corresponds to rotational phase of the guide shaft 6, the first detecting means 13*a* counts the number of rotations of the guide shaft 6. Further the control means 9 is connected to a second detector 13*b* which detects the fluid pressure and ejecting rate of the fluid ejected by the fluid ejectors 1*a* to 1*k*. In this embodiment, the second detector 13*b* detects the regulation rate of the regulator 8*a* and the valve 8*b*. On the other hand, the control unit 9 is electrically communicated with the driving unit 3 for the shifting means 15 and adjusting units 8*aa* and 8*bb* for the regulator 8*a* and the valve 8*b*.

Additionally, the control means 9 is electrically connected to the similar means and members belonging to the other web width adjusting devices, not shown, to perform the width adjusting operation in the whole printing system.

Alternatively, the control means 9 may be communicated with these detecting means and driving means by any conventional radio means.

FIG. 1 shows the preceding printing section P and the succeeding printing section P' which include two blanket cylinders BC, respectively.

Figure 2:
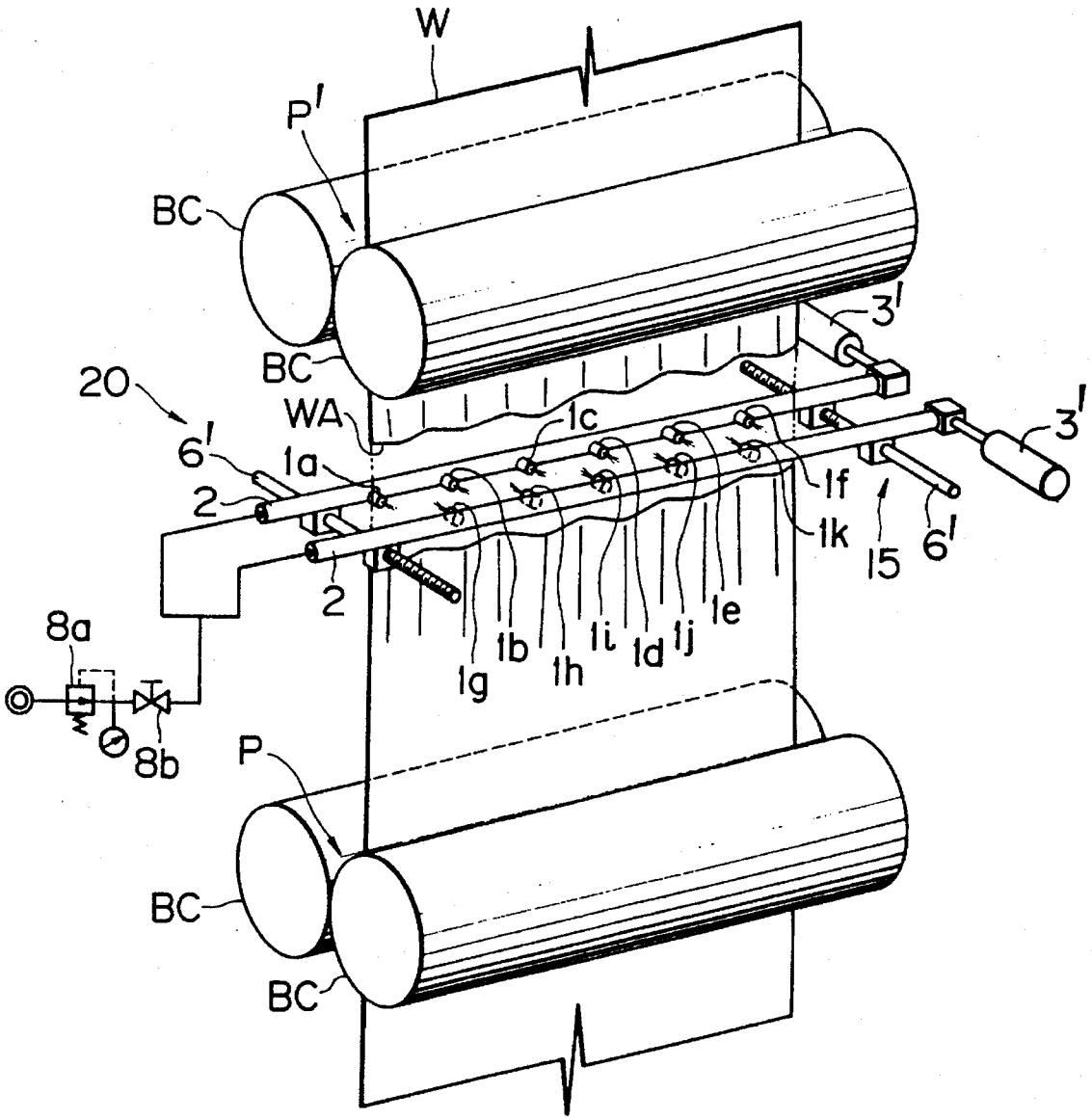
FIG. 2 is a schematically perspective view showing the second embodiment of a web width adjusting device according to the present invention.

FIG. 2 shows the second embodiment of a web width adjusting device according to the present invention, wherein the automatic control means 9 is omitted and the shifting mean 15 includes fluid pressure activating cylinders 3' as the driving unit and guide shafts 6'.

A typical operation of the printing system using the web width adjusting devices will be described in detail.

The paper web W is set in the printing system shown in FIG. 3 such that the web W is successively travelled through the printing sections P1, P2, P3, and P4 with passing through between the first series of the fluid ejectors 1*a* to if and the second series of the fluid ejectors 1*g* to 1*k* of the web width adjusting devices 20.

After or prior to the above described work, required information on the paper web such as width, material, thickness, and the like are input into the control means 9 through the input means 10. The control means 9 outputs an actuating signal from the detecting means 13*a* so that the fluid ejectors 1*a* to 1*k* are set at their initial positions predetermined in response to the web information. Additionally, the control means 9 outputs a control signal to the regulator unit 8 with referring to the detected signal from the detecting means 13*b* so that the fluid ejectors 1*a* to 1*k* are set in their initial fluid pressure and ejecting rate predetermined in response to the web information.

Then a start switch, not shown, for the printing system is turned on to start travelling the paper web W and printing operation of the printing sections P1, P2, P3, and P4.

As the printing sections begin their rotational work, the detecting means 11 detects the rotating speed of the main motor 12, representing the travelling speed of the paper web W, and inputs the detected information to the control means 9. According to the information on the travelling speed of the paper web W corresponding to the rotating speed of the main motor 12, the control means 9 outputs an adjusting signal to shift the fluid ejectors 1*a* to 1*k* from their initial positions to predetermined adjusting positions, and/or the control means 9 outputs an actuating signal to actuate the regulator unit 8 to adjust the fluid pressure and ejecting rate of the fluid ejected from the fluid ejectors 1*a* to 1*k*.

At the first printing section P1, the first image is printed on the paper web W and simultaneously blank sections of the printed web are supplied with dampening water through the blanket surface of the blanket cylinder BC. Thus wetted fibers of the paper web W become gradually extending in the width direction of the web W during travelling from the preceding printing section P (P1, P2, P3) to the succeeding printing section P' (P2, P3, P4). When the web W is passed through the web width adjusting device 20 prior to the secceeding printing section P', the web W is subjected to the pressurized air alternately ejected by the fluid ejectors 1*a* to 1*k* so that the web surface is formed in wave WA. The wavy surface WA allows the primary width of the paper wave W to be decreased 11, l2. Thus, on this stage, the actual width of the paper web W is represented by "l".

Although the wavy surface WA gradually returns to its primary shape after passing the web width adjusting device 20, the web width can not be completely returned to its primary width at the succeeding printing section P' (P2, P3, P4) and thus the paper web W is slightly smaller than its primary width when it enters into the succeeding printing section P' (P2, P3, P4). Therefore the extended width due to the dampening water at the preceding printing section P (P1, P2, P3) is cancelled by this shortened width. As a result, the paper web W without any faults such as visible wrinkels and rucks is printed at the succeeding printing section P' (P2, P3, P4) so that the succeeding image and lines can be printed consistent with the preceding image. On the same occasion, the blank section of the paper web is supplied with dampening water through the blanket surface of the blanket cylinder BC in the same manner as the preceding printing section P(P1, P2, P3).

Next, the paper web W is successively travelled to the succeeding printing section (the third or fourth printing section P3 or P4) through another web width adjusting device 20 arranged prior to the third or fourth printing section P3 or P4. In this web width adjusting device 20, the paper web W is also subjected to the same adjusting operation as the former adjusting means.

In each of the web width adjusting devices 20, the positions of the fluid ejectors 1*a* to 1*k* against the paper web W and the ejecting pressure and ejecting rate of the fluid ejected by the fluid ejectors should be adequately adjusted in response to the travelling speed of the paper web W because the wetted fibers will expand in propotion to time. In other words, the fluid ejectors 1*a* to 1*k* should be largely shifted when the paper web W is travelled at a slow speed.

According to the web width adjusting device 20, the web width at the succeeding printing section P' (P2, P3, P4) can be adjusted consinstent with that of the preceding printing section P (P1, P2, P3). Thus the image and lines printed at the first to fourth printing sections P1 to P4 can be formed consistent with each other.

In an experimental test executed by the present applicant, a rolled newspaper type A (width 1626 mm) was used to clarify the difference between the effect obtained by the web width adjusting devices 20 arranged between P1 and P2, P2 and P3, and P3 and P4 as shown in FIG. 3 and that of a conventional constitution without any web width adjusting means. This experimental test evidenced that shears (about 2 mm) generated in the width direction between the first printed image and lines and the fourth printed image and lines by conventional constituton can be wholly corrected by the web width adjusting device 20 according to the present invention. Although the expanding ratio in the web width depends on the type of paper web, the web width adjusting device according to the present invention can adequately compensate such shears in printing.

The automatic control means 9 may be replaced by manual control means.

The present invention is not limited to only the above described embodiments, and therefore for example the fluid ejectors 1*a* to 1*k* of the web width adjusting device 20 may be modified in any adequate shapes and numbers. Further the control means 9 may be input with the information on the dampening water fed onto the web paper W at the printing sections P1 to P3; i.e., ratio between image area and blank area to be printed at the printing sections P1 to P3. Various changes and modifications are possible without departing from the spirit and scope of the invention.

As disclosed in the above description, since expansion in web width due to dampening can be adequately corrected by the web width adjusting device arranged between the preceding printing section and the succeeding printing section, the image and lines printed at the succeeding printing section can be completely accorded with the former image and lines, thereby producing high quality printed matters without any shears or unclearness.

What is claimed is:

1. A printing system comprising:

dampening means for applying water to a paper web to be printed, first and second vertically arranged printing sections for successively printing an image on the paper web; and a web width adjusting device including a wave forming means between which the paper web vertically travels from the first to the second printing section, said wave forming means including a first support member operatively connected to a second support member by at least one guide member, said first support member and said second support member, respectively, having a first and second plurality of fluid ejectors which are located in substantially the same position in a longitudinal direction of the paper web and which are aligned in the width direction of the paper web;

wherein said first plurality of fluid ejectors have one alignment having a given interval between the fluid ejectors, and face alternately said second plurality of fluid ejectors which have another alignment so that each fluid ejector of the second plurality is positioned at the center of the interval between a respective pair of fluid ejectors of the first plurality; and wherein every fluid ejector of the first plurality and the second plurality applies an operative force to the paper web at a different position along said width direction of the paper web.

2. The web width adjusting device as set forth in claim 1, wherein said fluid ejectors are air ejecting members.

3. The web width adjusting device as set forth in claim 1 further comprising shifting means which allow said wave forming means to be shifted against the web surface so that said fluid ejectors are positioned selectively close to or apart from the web surface.

4. The web width adjusting device as set forth in claim 1, further comprising a regulator unit for each alignment of said fluid ejectors, which regulate ejecting pressure and ejecting rate of the fluid ejected from said fluid ejectors.

5. The web width adjusting device as set forth in claim 1 further comprising a control means for controlling said fluid ejectors in response to at least one of various information on the paper web per se selected from the group comprising material, width, and thickness, and a web travelling condition.

6. The web width adjusting device as set forth in claim 5, further comprising shifting means which allow said wave forming means to be shifted against the web surface so that said fluid ejectors are positioned selectively close to or apart from the web surface; and a regulator unit for each alignment of said fluid ejectors, which regulate ejecting pressure and ejecting rate of the fluid ejected from said fluid ejectors;

wherein said control means is electrically connected to said shifting means and said regulator unit so that said shifting means and said regulator unit are automatically controlled.

7. A lithographic printing system comprising:

a plurality of printing sections vertically arranged along a paper web travelling line, and a plurality of web width adjusting devices each of which is arranged prior to one of the printing sections, wherein each web width adjusting device includes wave forming means between which the paper web vertically travels from the first to the second printing section, each of said wave forming means including a first support member Operatively connected to a second support member by at least one guide member, said first support member and said second support member, respectively, having a first and second plurality of fluid ejectors which are located in substantially the same position in a longitudinal direction of the paper web and which are aligned in the width direction of the paper web; and wherein said first plurality of fluid ejectors have one alignment having a given interval between the fluid ejectors, and face alternately said second plurality of fluid ejectors which have another alignment so that each fluid ejector of the second plurality is positioned at the center of the interval between a respective pair of fluid ejectors of the first plurality so that an operative fluid force is provided from each of said first and said second plurality of fluid ejectors and engages the paper web at a different position across the width direction of the paper web.

8. The lithographic printing system as set forth in claim 7, wherein said fluid ejectors are air ejecting members.

9. The lithographic printing system as set forth in claim 7, wherein said wave forming means includes a shifter which shifts said wave forming means against the web surface so that said fluid ejectors are positioned selectively close to or apart from the web surface.

10. The lithographic printing system as set forth in claim 7, further comprising a regulator unit for each alignment of said fluid ejectors, which regulate ejecting pressure and ejecting rate of fluid ejected from said fluid ejectors.

11. The lithographic printing system as set forth in claim 7, further comprising a controller for controlling said wave forming means in response to a web travelling condition and at least one item of data on the paper web per se selected from the group comprising material, width, and thickness.

12. The lithographic printing system as set forth in claim 11, further comprising a regulator unit for each alignment of said fluid ejectors, which regulate ejecting pressure and ejecting rate of fluid ejected from said fluid ejectors; and further comprising a shifter which shifts said wave forming means against the web surface so that said fluid ejectors are positioned selectively close to or apart from the web surface;

wherein said controller is electrically connected to said shifter and said regulator unit so that said shifter and said regulator unit are automatically controlled.

13. A web width adjusting method comprising the steps of:

vertically arranging first and second printing sections for successively printing an image on the web; and forming a wave in the web by alternately ejecting fluid to both sides of the web from wave forming means including a first support member operatively connected to a second support member by at least one guide member, said first support member and said second support member, respectively, having a plurality of fluid ejectors which are located in substantially the same position in a longitudinal direction of the paper web and which are arranged in two alignments along the width direction of the web;

wherein said fluid ejectors of one alignment have a given interval between them and face alternately said fluid ejectors of the other alignment so that each fluid ejector of the other alignment is positioned at the center of the interval between a respective pair of fluid ejectors of the one alignment so that every fluid ejector applies a pressure force to the web at a different position across the width direction of the paper web.

14. A printing system comprising: a dampening means for applying water to a paper web to be printed, first and second printing sections arranged for successively printing an image on the paper web;

a web width adjusting device located between said first and second printing sections, said web width adjusting device including a first wave forming means having a first plurality of fluid ejectors provided on a first support member located on a first side of the paper web and a second wave forming means having a second plurality of fluid ejectors provided on a second support member located on a second side of the paper web; and a shifting means that selectively positions at least one of said first support member and said second support member close to or apart from the paper web, said shifting means having at least one guide shaft operatively connected to said first support member and said second support member.

15. The printing system of claim 14, wherein said first support member and said second support member, respectively, comprise first and second fluid feeding pipes that, respectively, feed fluid to said first plurality of fluid ejectors and said second plurality of fluid ejectors.

16. The printing system of claim 15, wherein said shifting means further comprises a drive unit that drives a driving gear meshingly engaged with a driven gear secured to one end of the at least one guide shaft.

17. The printing system of claim 15, wherein the at least one guide shaft comprises a guide shaft having a portion that passes through a first base member secured to one of said first and second fluid feeding pipes and a screw portion that engages a second base member secured to the other of said first and second fluid feeding pipes.

18. The printing system of claim 15, wherein said at least one guide shaft comprises a first and second guide shaft, said first guide shaft having a portion that passes through a first base member secured to said first fluid feeding pipe and a screw portion that engages a second base member secured to said second fluid feeding pipe; and wherein said second guide shaft has a portion that passes through a third base member secured to said second fluid feeding pipe and a screw portion that engages a fourth base member secured to said first fluid feeding pipe.

19. The printing system of claim 15, wherein said first plurality of fluid ejectors are provided on said first fluid feeding pipe having one alignment and face alternately said second plurality of fluid ejectors provided on said second fluid ejector which have another alignment.

20. The printing system of claim 14, wherein said shifting means comprises a first fluid pressure activating cylinder operatively connected to the first support member and a second fluid pressure activating cylinder operatively connected to said second support member.

21. The printing system of claim 20, wherein said first support member and said second support member, respectively, comprise first and second fluid feeding pipes that, respectively, feed fluid to said first plurality of fluid ejectors and said second plurality of fluid ejectors.

22. A web width adjusting device comprising:

a first fluid feeding pipe having a first plurality of fluid ejectors;

a second fluid feeding pipe having a second plurality of fluid ejectors facing said first plurality of fluid ejectors;

a first guide shaft having a portion that passes through a first base member secured to said first fluid feeding pipe and a screw portion that engages a second base member secured to said second fluid feeding pipe;

a second guide shaft having a portion that passes through a third base member secured to said second fluid feeding pipe and a screw portion that engages a fourth base member secured to said first fluid feeding pipe;

a first drive unit that drives a first driving gear meshingly engaged with a first driven gear secured to an end of said first guide shaft; and a second drive unit that drives a second driving gear meshingly engaged with a second driven gear secured to an end of said second guide shaft.

* * * * *